US007117922B2

(12) United States Patent
Tony

(10) Patent No.: US 7,117,922 B2
(45) Date of Patent: Oct. 10, 2006

(54) DIY WINDOW CURTAIN

(76) Inventor: Hsu Tony, P.O. Box 2-10, Tainan City (TW)

( * ) Notice: Subject to any disclaimer, the term of this patent is extended or adjusted under 35 U.S.C. 154(b) by 204 days.

(21) Appl. No.: 10/867,553

(22) Filed: Jun. 10, 2004

(65) Prior Publication Data

US 2005/0006036 A1 Jan. 13, 2005

(30) Foreign Application Priority Data

Jul. 9, 2003 (TW) ..... 92118705 A

(51) Int. Cl.
*E06B 9/56* (2006.01)
*E06B 3/46* (2006.01)

(52) U.S. Cl. ..... 160/330; 160/176.1 V; 160/402; 160/206; 160/123; 16/93; 16/96

(58) Field of Classification Search ..... 16/37 R, 16/87.4 R, 91, 93 R, 93 D, 94 D, 96 R, 95 R; 160/330, 206, 176.1 V, 177 V, 178.1 V, 402, 160/123

See application file for complete search history.

(56) References Cited

U.S. PATENT DOCUMENTS 3,194,298 A * 7/1965 Sussin ..... 160/35
3,296,651 A * 1/1967 Baker ..... 16/87.4 R
3,818,543 A * 6/1974 Baker, Sr. ..... 16/87.4 R
6,167,939 B1 * 1/2001 Barone ..... 160/330

* cited by examiner

*Primary Examiner*—Hugh B. Thompson, II
*Assistant Examiner*—Candace L. Bradford

(57) ABSTRACT

A DIY window curtain able to be combined by a user includes a plurality of hang rods and a pulley base. The hang rods are respectively inserted through the hang hole of a curtain, which is formed with pleated edges according to the length of each hang rod. The pulley base is provided with two symmetrical combining members to be symmetrically combined and fitted around the hang rod. The pulley base is fixed with a pulley rod having its pulley fitted in the rail groove of a sliding rail, enabling the window curtain to be assembled, shrunk or expanded.

1 Claim, 7 Drawing Sheets

DIY WINDOW CURTAIN

FIELD OF THE INVENTION

This invention relates to a DIY window curtain able to be combined by a user, particularly to one including a plurality of combining members provided independently, able to be assembled easily by a user when it is to be used.

BACKGROUND OF THE INVENTION

A conventional window curtain, as shown in FIG. 1, includes a plurality of hang hooks (A0) respectively having the lower end hooking a proper portion of a curtain (A1) and the upper end hooking the lower end of a sliding member (A2), which has its pulley (A3) received in the rail groove (A5) of a sliding rail (A4) to fix the window curtain (A1) in place.

However, the conventional window curtain (A1) has the following drawbacks.

1. The curtain is hooked by the hang hooks only so it is likely to fall off from the hang hooks after used for a period of time.

2. To disassemble and replace the curtain, the hang hooks have to be separated from the curtain one by one, resulting in much inconvenience in use.

SUMMARY OF THE INVENTION

The objective of the invention is to offer a DIY window curtain able to be combined by a user, easy to be assembled and disassembled and convenient to be replaced with a new one of different colors, designs or shapes.

The features of the invention are described below.

1. The window curtain is provided with a plurality of hang rods made of plastic with excellent flexibility and respectively having one end formed integral with a thin elongate rod which can be bent freely but can hardly be broken. Every abutting hang rods can be connected by the flexible thin elongate rod to enable the window curtain to be collapsed or expanded.

2. The window curtain is provided with a pulley base composed of two symmetrical combining members, which are combined together and fitted around the hang rod. After the two symmetrical combining members are fixedly assembled with a pulley rod, they are firmly combined together by a nut, and a pulley on the upper end of the pulley rod is fitted in the rail groove of a sliding rail, enabling the window curtain to be shrunk or expanded.

BRIEF DESCRIPTION OF DRAWINGS

This invention will be better understood by referring to the accompanying drawings, wherein.

DETAILED DESCRIPTION OF THE INVENTION

A preferred embodiment of a window curtain able to be combined by a user in the present invention, as shown in FIGS. 2 to 8, includes a plurality of hang rods 1 and a pulley base 2 as main components combined together.

Figure 1:
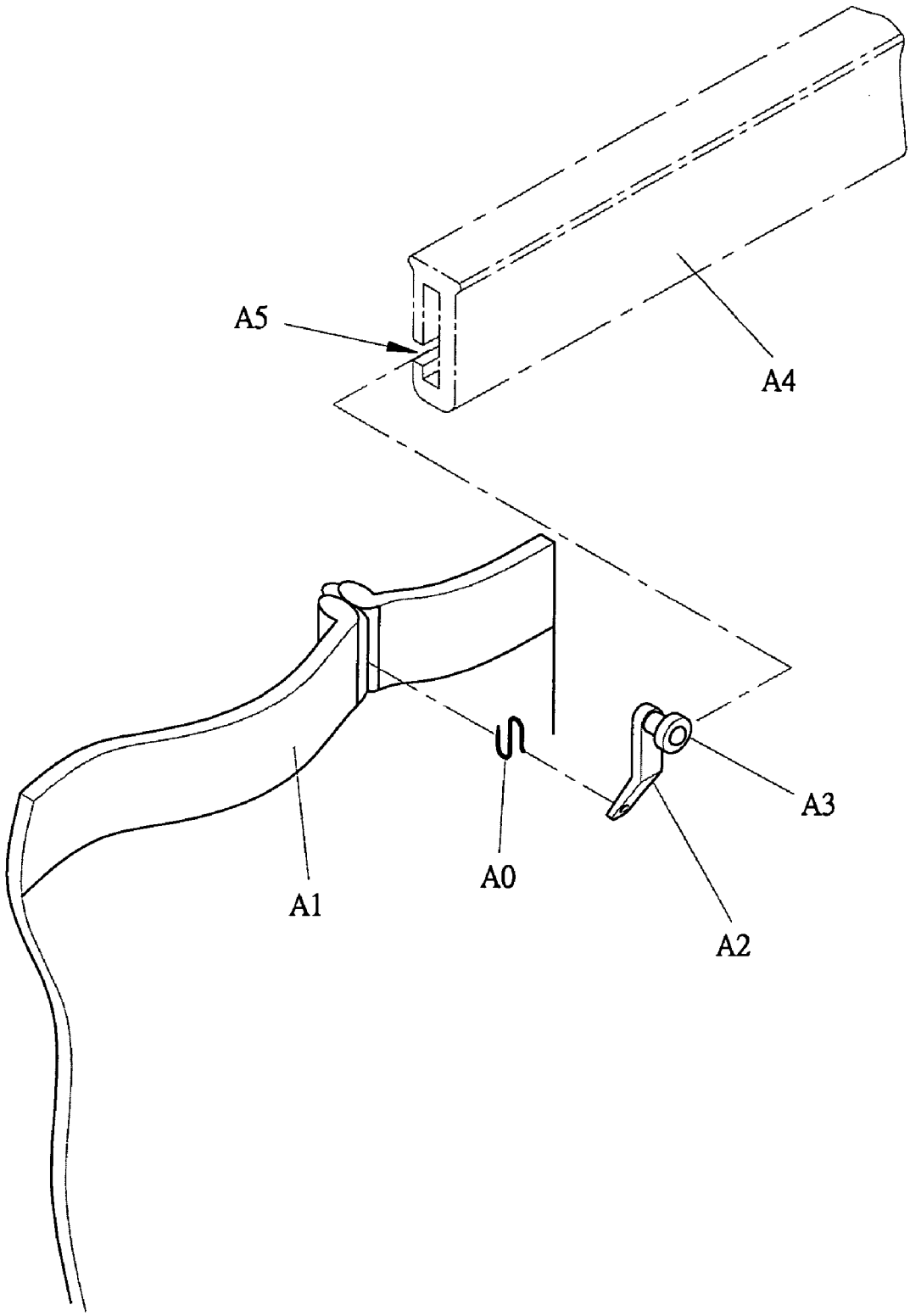
FIG 1 (PRIOR ART)
FIG. 1 is an exploded perspective view of a conventional window curtain.
Figure 2:
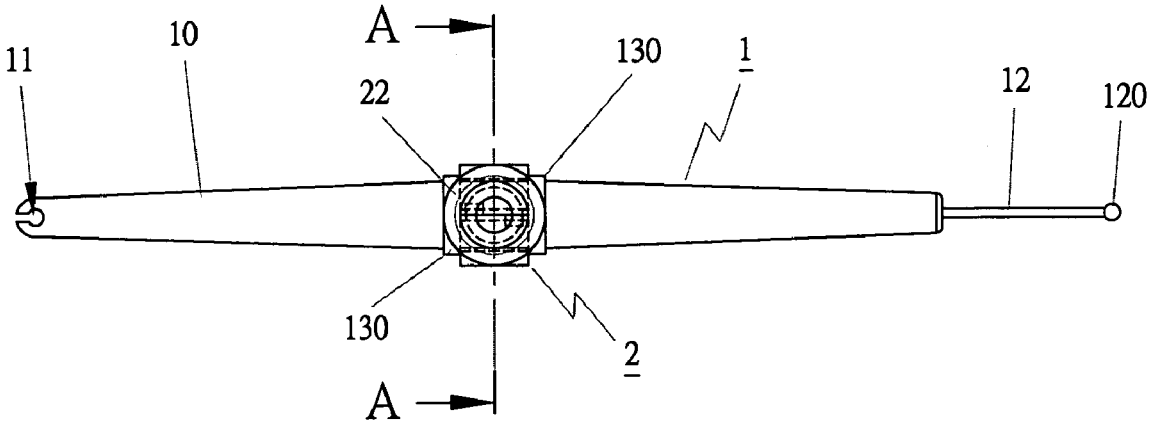
FIG. 2 is an upper view of a hang rod combined with a pulley in the present invention.
Figure 3:
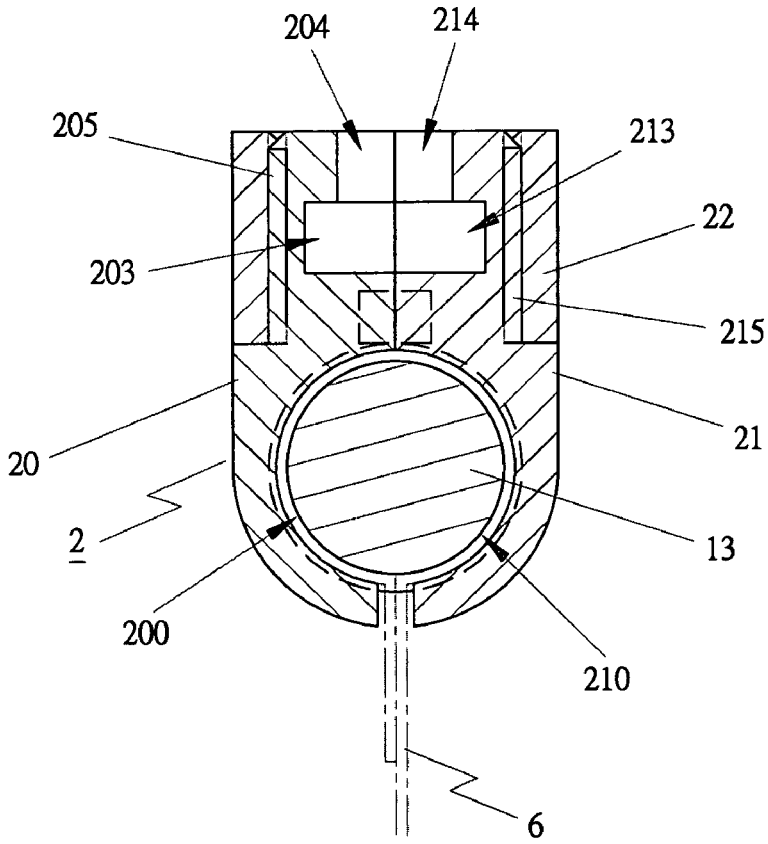
FIG. 3 is a cross-sectional view of the line A—A in FIG. 2.
Figure 4:
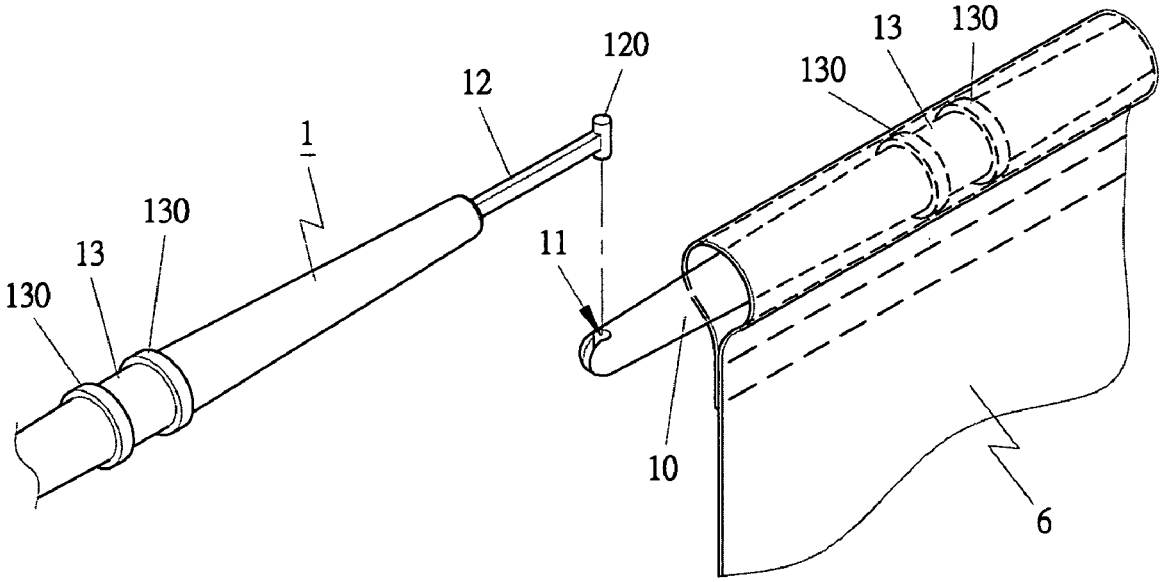
FIG. 4 is a perspective view of two abutting hang rods disconnected in the present invention.
Figure 5:
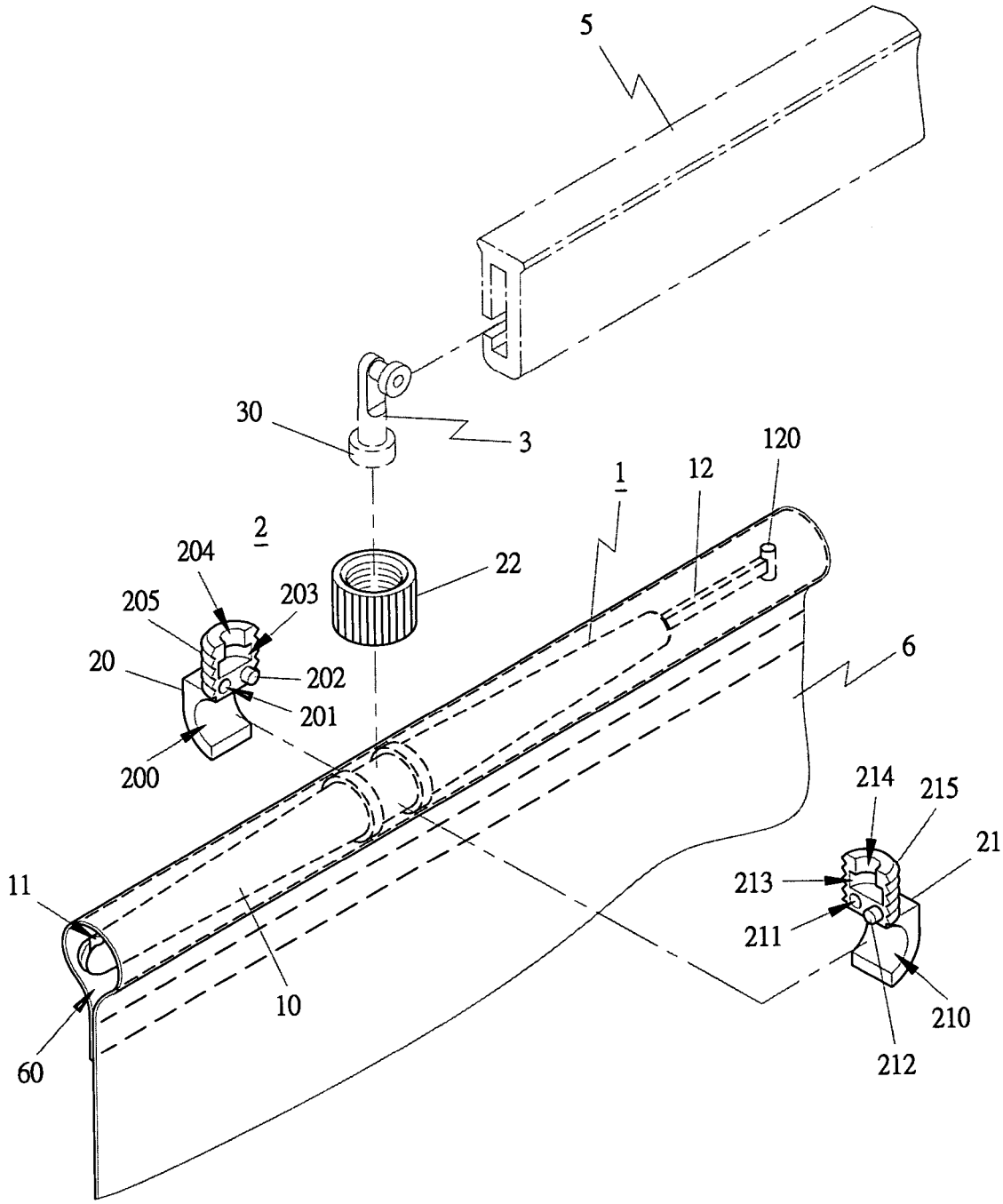
FIG. 5 is an exploded perspective view of the pulley base before combined with the hang rod in the present invention.
Figure 6:
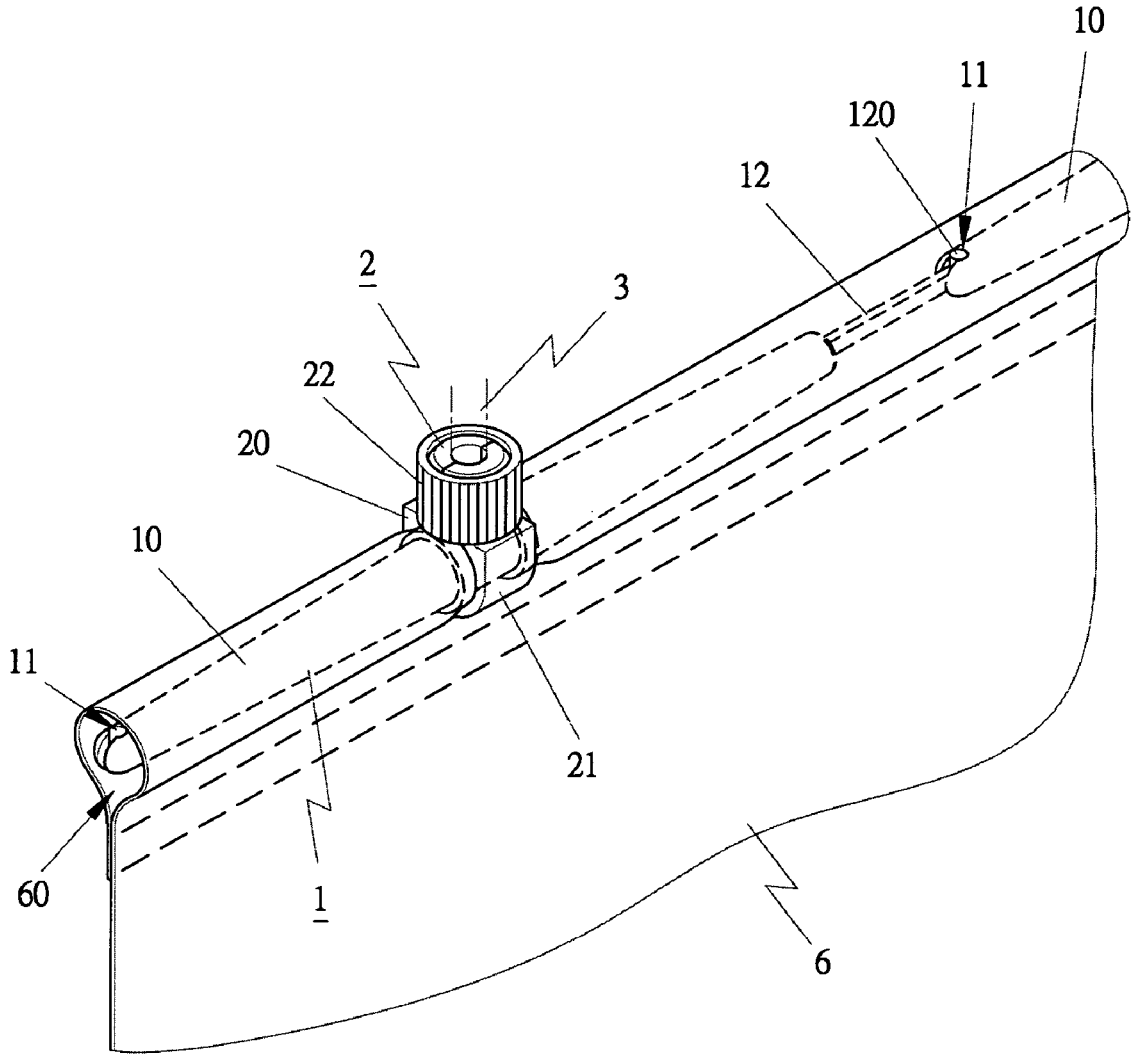
FIG. 6 is a perspective view of a DIY window curtain able to be combined by a user in the present invention.
Figure 7:
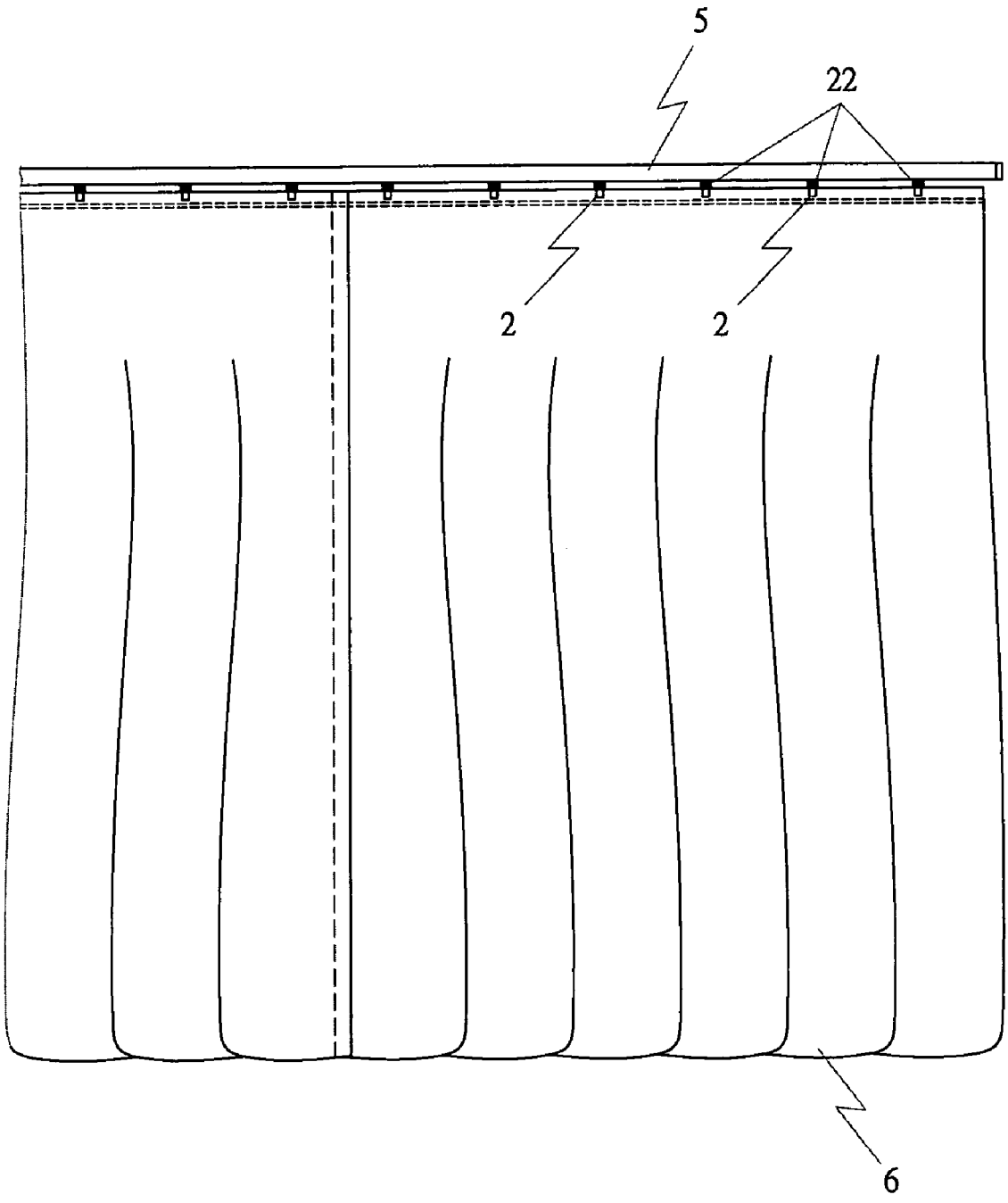
FIG. 7 is a front view of the DIY window curtain in an expanded condition in the present invention.
Figure 8:
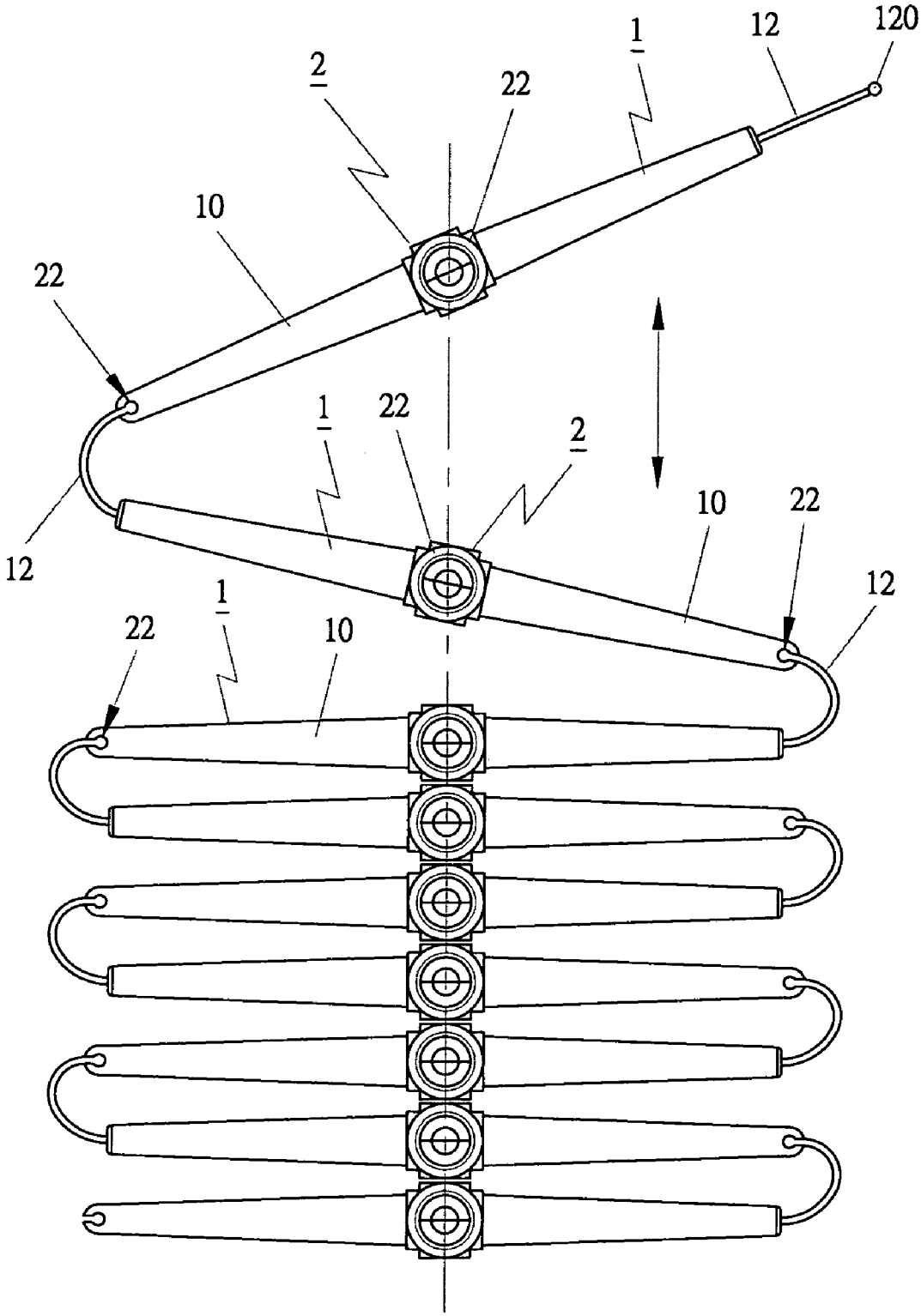
FIG. 8 is a front view of the window curtain in a shrunk condition in the present invention.

The hang rods 1 are made of plastic with excellent flexibility and hardly-broken property, respectively having a rod body 10 able to be made into different lengths for a user to select freely. The rod body 10 of each hang rod 1 has one end bored with a C-shaped engage groove 11 and the other end formed integral with a thin elongate rod 12 having a column-shaped end 120. When two abutting hang rods 1 are to be connected together, one hang rod 1 has the column-shaped end 120 of its thin elongate rod 12 combined with the C-shaped groove 11 of another hang rod 1, as shown in FIG. 4. Thus, all the hang rods 1 can be connected with one another in the same way, as shown in FIGS. 7 and 8, and after connected together, they can hardly be separated. Further, the rod body 10 of each hang rod 1 is formed in the center with a combining portion 13 having opposite ends respectively provided with a projecting circumferential edge 130 for positioning a pulley base 2 thereon after the pulley base 2 is combined with the combining portion 13 of the rod body 10.

The pulley base 2 includes a first combining member 20 and a second combining member 21 provided symmetrically. The first and the second combining member 20, 21 are respectively and symmetrically provided with an arc-shaped groove 200, 210, which, after combined together, has an inner diameter equivalent to the outer diameter of the combining portion 13 of the hang rod 1 so that the two arc-shaped grooves 200, 210 can be combined together and firmly fitted around the combining portion 13 of the hang rod 1. Further, the first and the second combining member 20, 21 are respectively and symmetrically provided with an engage hole 201, 211 and an engage projection 202, 212 so that the two combining members 20, 21 can be firmly combined together by mutual engagement of the engage holes 201, 211 with the engage projections 202, 212. Furthermore, the first and the second combining member 20, 21 are respectively and symmetrically bored with a pulley rod groove 203, 213 and a rod hole 204, 214. Thus, a pulley rod 3 has its lower projecting end 30 fixed in the two pulley rod grooves 203, 213 to prevent the pulley rod 3 from escaping from the pulley base 2 and its upper portion extending out of the two rod holes 204, 214. In addition, the first and the second combining member 20, 21 have their upper portions respectively and symmetrically provided with male threads 205, 215 so that the pulley rod 3 and the pulley base 2 can be firmly locked together by a nut 22 screwed with the male threads 205, 215 after the two combining members 20, 21 are combined. Then, the pulley of the pulley rod 3 is fitted in the rail groove of a sliding rail 5 to enable the window curtain to be expanded, as shown in FIG. 7, or collapsed, as shown in FIG. 8.

In using, the hang rods 1 are first connected together and inserted through the hang hole 60 of a curtain 6, and then the hang rods 1 and the pulley base 2 and the pulley rod 3 are combined with one another to finish assembly of the window curtain, able to assemble or disassemble the window curtain conveniently.

While the preferred embodiment of the invention has been described above, it will be recognized and understood that various modifications may be made therein and the appended claims are intended to cover all such modifications that may fall within the spirit and scope of the invention.

What is claimed is:

1. A window curtain able to be combined by a user, said window curtain comprising:

a plurality of hang rods respectively having a rod body, said rod body having one end bored with a C-shaped engage groove and the other end formed with a thin elongate rod, said thin elongate rod formed with a column-shaped end, said rod body provided with a combining portion for fitting a pulley base thereon, said combining portion of said rod body having its opposite ends respectively provided with a projecting circumferential edge; and the pulley base comprising two symmetrical combining members, said two combining members respectively provided with an arc-shaped groove, said two arc-shaped grooves firmly fitted around said combining portion of said rod body, said two combining members respectively and symmetrically provided with an insert hole and a projection, said two combining members combined together by mutual engagement of said insert holes and said projections, said two combining members respectively and symmetrically provided with a pulley rod groove and a pulley rod hole, said two pulley rod grooves combined together for receiving a lower projecting end of a pulley rod, said two combining members having their upper portions respectively and symmetrically bored with rod hole, said pulley rod having its upper portion extending out of said rod hole, said two combining members having their upper outer walls respectively and symmetrically formed with male threads, a nut screwed with said male threads of said two combining members to fix said pulley rod and said pulley base together.

* * * * *